US005390712A

United States Patent [19]

Parrish et al.

[11] Patent Number: 5,390,712

[45] Date of Patent: Feb. 21, 1995

[54] FUEL DISPENSING AND VAPOR RECOVERY NOZZLE

[75] Inventors: David J. Parrish, Wake Forest; Chih-Kun Shih, Cary; John L. Johnson, Raleigh, all of N.C.

[73] Assignee: Emco Wheaton, Inc., Morrisville, N.C.

[21] Appl. No.: 130,277

[22] Filed: Oct. 1, 1993

[51] Int. Cl.[6] ..... B67D 5/00

[52] U.S. Cl. ..... 141/59; 141/206; 141/392

[58] Field of Search ..... 141/44, 45, 59, 206, 141/209–211, 214, 217, 302, 392; 138/114

[56] References Cited

U.S. PATENT DOCUMENTS

| | | | |
|---|---|---|---|
| 4,157,104 | 6/1979 | Lofquist, Jr. | 141/392 X |
| 4,351,375 | 9/1982 | Polson | 141/98 |
| 4,429,725 | 2/1984 | Walker et al. | 141/59 |
| 4,566,504 | 1/1986 | Furrow et al. | 141/59 |
| 4,572,255 | 2/1986 | Rabinovich | 141/217 |
| 4,649,969 | 3/1987 | McMath | 141/290 |
| 4,906,496 | 3/1990 | Hosono et al. | 138/114 |
| 5,178,197 | 1/1993 | Healy | 141/217 |
| 5,234,036 | 8/1993 | Butkovich et al. | 141/59 X |
| 5,285,826 | 2/1994 | Sanders et al. | 141/59 |
| 5,297,594 | 3/1994 | Rabinovich | 141/59 |

*Primary Examiner*—J. Casimer Jacyna
*Attorney, Agent, or Firm*—Bell, Seltzer, Park & Gibson

[57] ABSTRACT

A fuel dispensing and vapor recovery nozzle includes a body portion having a fuel passageway therethrough, a main valve in the fuel passageway for controlling the flow of fuel therethrough, a manually operable valve actuating lever for opening the main valve, a pivot member mounting the lever for pivotal movement, an elongate pivot mounting member carrying the pivot member and mounted for sliding longitudinal movement, a venturi responsive to fuel flow through the fuel passageway for creating a vacuum, a shut-off passageway from the venturi to the spout adapted to be closed when the fuel tank is filled, a locking device normally locking the pivot mounting member against longitudinal movement so that the pivot member is stationary and the lever is operable to open the main valve, a vacuum responsive device for rendering the locking device inoperable upon the shut-off passageway becoming blocked, a vapor recovery passageway in the body portion extending longitudinally therethrough, a vapor recovery passageway in the spout and having a large area inlet in the side of the spout near but spaced from the outer end of the spout and an outlet opening in the side of the spout near but externally of the body portion and vapor confinement and a directing sleeve for confining vapors leaving the outlet opening and directing those vapors into the vapor recovery passageway in the body portion.

8 Claims, 5 Drawing Sheets

FUEL DISPENSING AND VAPOR RECOVERY NOZZLE

FIELD OF THE INVENTION

This invention relates to fuel dispensing systems for dispensing of fuel into a vehicle fuel tank and more particularly to a fuel dispensing and vapor recovery nozzle.

BACKGROUND OF THE INVENTION

Systems for dispensing fuel into vehicle fuel tanks are in common use. These systems typically include a nozzle connected to a pump by a fuel delivery hose. Such nozzles are manually operable and include a spout to be inserted in the fill tube of the vehicle fuel tank. These nozzles include valves under the control of the operator for dispensing fuel through the nozzle into the vehicle tank until the tank is full. Usually a shut-off mechanism is provided and disconnects the manually operable valve lever from the valve when the fuel tank is filled with fuel. Such shut-off mechanisms are typically responsive to fuel flow through the nozzle by a venturi which creates a partial vacuum in a shut-off tube that extends to the outer end of the spout.

Heretofore, shut-off mechanisms for disconnecting the manually operable lever from the main valve have employed complicated valves and linkages which are subject to malfunctions. In addition, such mechanisms are expensive and difficult to assemble and maintain.

Environmental concerns have dictated that fuel dispensing systems include means for recovering vapors from the vehicle tank as such vapors are dispelled by the rising level of fuel being dispensed into the vehicle tank. Examples of such vapor recovery nozzles are disclosed in U.S. Pat. Nos. 4,351,375; 4,429,725; and 4,649,969. These vapor recovery nozzles suffer from several deficiencies and disadvantages. Firstly, all of these nozzles have the inlet into the vapor recovery passageways located either externally of the fill opening into the vehicle tank as disclosed in U.S. Pat. No. 4,649,969 or closely adjacent to the outer end of the spout of the nozzle as disclosed in the other two patents. With the inlet opening into the vapor recovery passageway located closely adjacent the outer end of the nozzle, such inlet opening is spaced inwardly of the fill tube of the vehicle tank a considerable distance from the restrictor plate in that fill tube. Accordingly, considerable vapors can accumulate between the inlet opening of the vapor recovery tube and the restrictor plate in the fill tube of the vehicle tank.

Secondly, the vapor recovery fuel dispensing nozzles disclosed in U.S. Pat. Nos. 4,351,375 and 4,429,725 have the vapor recovery passageways extending into the mounting means for mounting the spout on the main body of the nozzles. Accordingly, the vapor recovery passageway must pass through the mounting means for the nozzle spout and invariably such passageway follows a tortuous path and is fairly restricted in area. Such a restricted passageway limits the volume of vapors that can be recovered.

With the forgoing in mind, it is an object of the present invention to provide a fuel dispensing and vapor recovery nozzle having a vapor recovery passageway in the spout of the nozzle with at least one inlet opening which can recover substantially all vapors from the vehicle fuel tank.

It is a more specific object of the present invention to provide a vapor passageway through the nozzle which is relatively straight and devoid of constrictions or substantial flow impeding changes in direction.

It is a further more specific object of the present invention to provide an improved shut-off mechanism that is simple in construction and efficient in operation and easy to install and maintain.

SUMMARY OF THE INVENTION

The foregoing objects of this invention are accomplished by a fuel dispensing nozzle including a body portion having a fuel passageway extending therethrough and communicating at its ingress end with a fuel supply hose connected to a dispensing pump. At the egress end of the fuel passageway through the body portion, a spout is mounted on the body portion and has a fuel delivery passageway therethrough which communicates with the fuel passageway in the body portion. A main valve is mounted in the fuel passageway in the body portion and is biased toward the closed position and moved to the open position by a manually operable lever when it is desired to dispense gasoline into the fuel tank of a vehicle.

An automatic shut-off mechanism is provided and includes a suction tube or a shut-off passageway in the spout which communicates at its outer end with the open end of the spout and which is connected at its inner end to a vacuum chamber within the body portion. The vacuum chamber is also connected to a venturi communicating with the fuel passageway through the body portion. Accordingly, when the main valve is open and fuel flows through the fuel passageway in the nozzle into the fuel tank of a vehicle a vacuum is created by the venturi in the vacuum chamber and from there to the shut-off passageway in the spout. So long as the shut-off passageway in the spout remains open, air will be drawn therethrough into the vacuum chamber.

The body portion also includes a vapor recovery passageway therethrough which communicates at its egress end with a vapor recovery hose within the fuel delivery hose. At its other end, the vapor recovery passageway communicates with a vapor recovery chamber defined by a vapor confinement member mounted on the egress end of the body portion. The vapor confinement member sealingly engages the spout in outwardly spaced relation to the means mounting the spout on the body portion. The spout includes a vapor recovery passageway therein with inlet openings or an elongate inlet opening therein. The inlet opening or openings have sufficient cross-sectional area to remove substantially all of the vapor from the vehicle fuel tank. The end of the vapor recovery passageway in the spout closest to the main body portion has an exhaust opening in the spout therein that is spaced outwardly from the spout mounting means and communicating with the vapor confinement chamber within the vapor confinement of means. Thus, vapor is recovered along the portion of the spout that is inserted into the fill tube below the restrictor plate and is exhausted into the vapor confinement chamber and thence directly into the vapor recovery passage through the main body portion of the nozzle. Accordingly, vapor is recovered in as close to a straight line path through the nozzle as can be accomplished given the shape of the nozzle. The vapor recovery passageway from the outer end of the spout to the fuel supply hose is open and devoid of any abrupt changes in direction or other substantial restrictions.

A vapor recovery valve is provided in the vapor recovery passageway in the body portion and operable with the main valve to close the vapor recovery passageway when the main valve is closed and to open the vapor recovery passageway when the main valve is open. Thus, the vapor recovery system will not operate when the nozzle is not dispensing fuel.

The fuel passageway through the body portion includes a fuel pressure sensing chamber through which fuel flows to the main valve. The pressure sensing chamber includes a fuel pressure responsive means which unlocks the locking mechanism that locks the pivot for the valve actuating lever in position to open the main valve when the dispensing pump is not in operation. The main valve is thusly prevented from being opened until the dispensing pump is in operation and fuel is supplied to the nozzle fuel passageway under pressure.

BRIEF DESCRIPTION OF THE DRAWINGS

In the drawings and specifications, there has been set forth a preferred embodiment of the invention, and although specific terms are employed, they are used in generic and descriptive sense only and not for purpose of limitation.

DETAILED DESCRIPTION OF THE PREFERRED EMBODIMENTS

Figure 1:
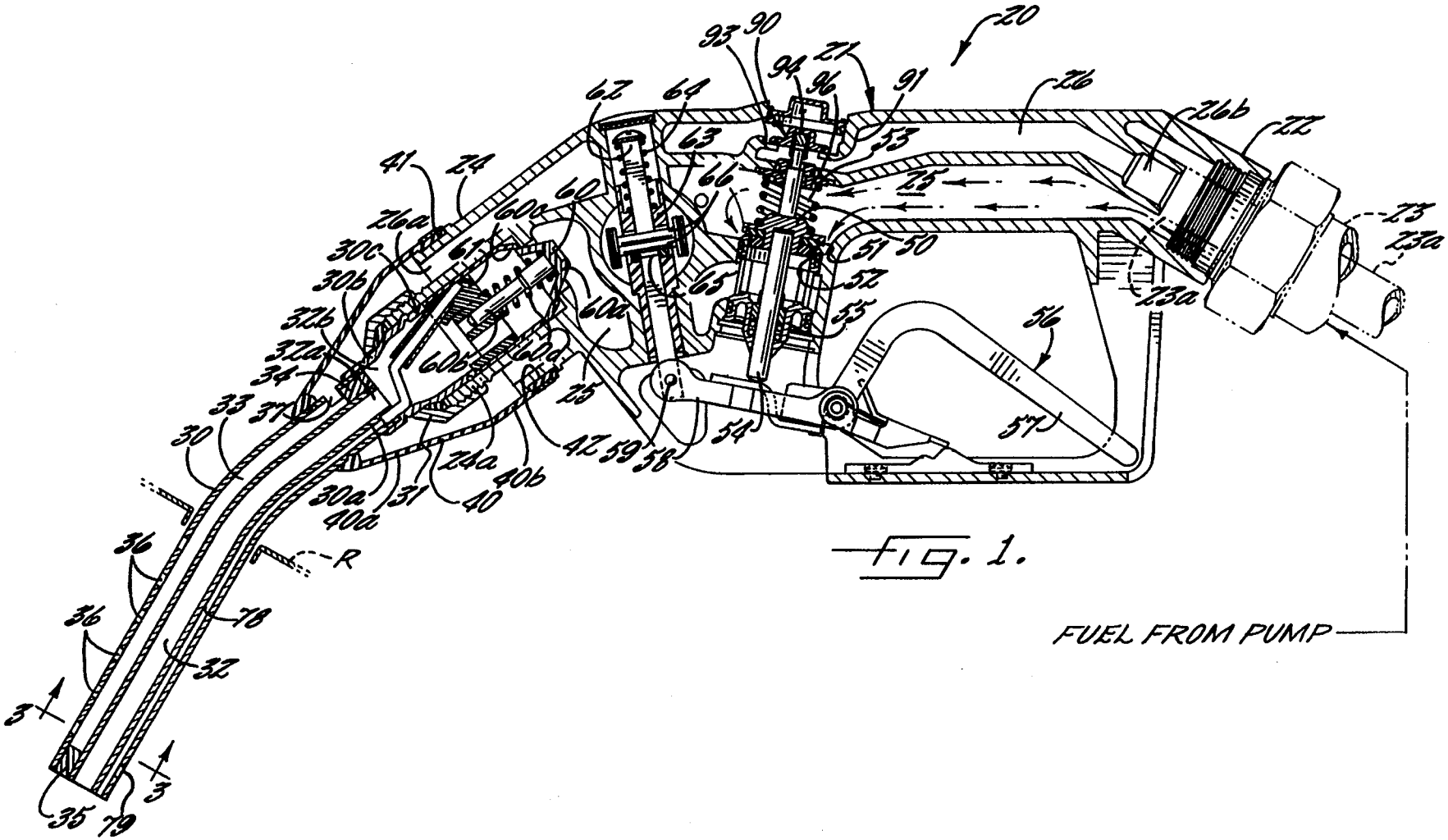
FIG. 1 is a vertical sectional view of a nozzle incorporating the features of the present invention.
Figures 2, 3:
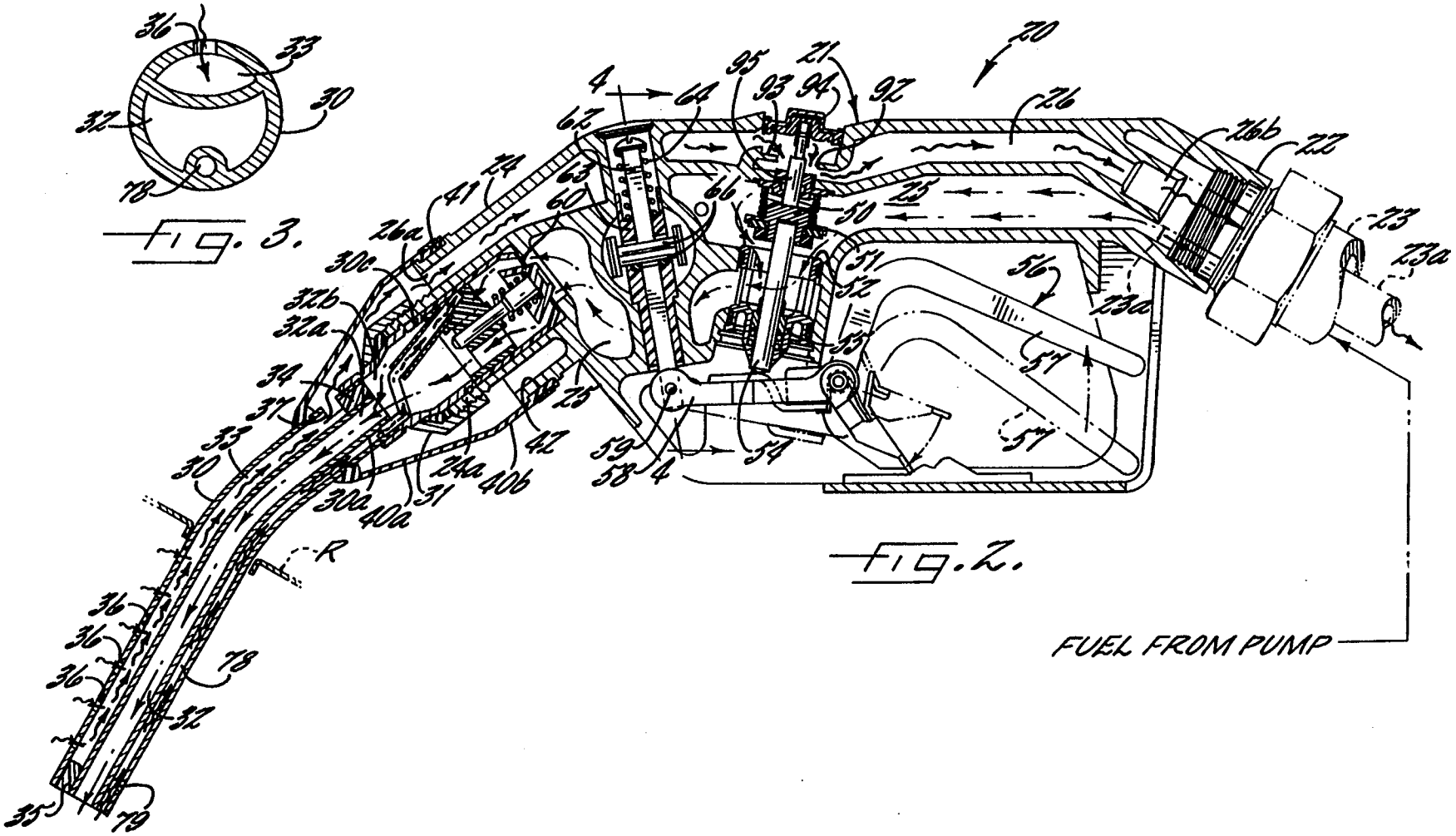
FIG. 2 is a view similar to FIG. 1, illustrating the main valve open and the fuel flowing through the nozzle and vapor being recovered from the vehicle fuel tank.
FIG. 3 is a transverse sectional view taken substantially along line 3—3 in FIG. 1.

Referring now more specifically to the drawings, there is illustrated therein a fuel dispensing and vapor recovery nozzle generally indicated at 20 (FIGS. 1 and 2) which incorporates the features of the present invention. Nozzle 20 includes a body portion 21 which has an ingress end 22 that is adapted to be connected to a fuel delivery hose 23 which in turn is connected to the dispensing pump (not shown) of the service station or the like. Body portion 21 also includes an egress end 24 at the end thereof opposite the ingress end 22.

Body portion 21 has therein a fuel passageway 25 which extends longitudinally through the body portion from the ingress end 22 to the egress end 24. Fuel passageway 25 communicates at the ingress end 22 of the body portion 21 with the fuel conduit in delivery hose 23. Body portion 21 also has a vapor recovery passageway 26 therein which runs longitudinally of the body portion 21 generally parallel to the fuel passageway 25. The vapor recovery passageway 26 is open at the egress end 24 of the body portion 21 as indicated at **26*a* and is connected at its other end 26*b* to a vapor recovery conduit 23*a* within the fuel delivery hose 23. The vapor recovery conduit 23*a* runs axially through the delivery hose 23** to a vacuum pump (not shown) at the underground tank of the fuel delivery system.

A spout 30 is mounted on the egress end 24 of the body portion 21 and specifically on an extension **24*a* which extends outwardly from the main portion of the body portion 21. Extension 24*a* is externally threaded and the fuel passageway 25 extends longitudinally therethrough. Spout 30 includes a body portion 30*a* and a bell-shaped end portion 30*h* fixedly connected to the inner end of the body portion 30*a*, as, for example, by brazing. Spout end portion 30*b* extends into extension 24*a* of body portion 21 and is sealed thereto by an O-ring 30*c*. A spout anchoring nut 31 surrounds the end portion 30*b* of spout 30 and is threadably received on the external threads of the extension 24*a* of the body portion 21**.

Spout 30 includes a fuel passageway 32 extending longitudinally therethrough. Spout fuel passageway 32 has a first passageway portion **32*a* in spout body portion 30*a* and a second passageway portion 32*b* in the bell-shaped end portion 30*b*. Spout passageway portion 32*b* communicates with fuel passageway 25 to receive fuel therefrom. Spout fuel passageway portion 32*a* is open at the terminal outer end of spout 30** to deliver fuel into the vehicle fuel tank.

Spout 30 also includes a vapor recovery passageway 33 therein which extends longitudinally through spout body portion **30*a* and is open at its opposite ends. However, in accordance with the present invention, vapor recovery passageway 32 is blocked or closed at its inner end by a plug 34 to prevent vapors from entering the bell-shaped end portion 30*h* of spout 30 and at its outer end by a plug 35 to prevent vapors from entering vapor recovery passageway 33 through the terminal end of spout 30**.

At least one inlet opening 36 is provided through the outer wall of spout 30 into the vapor recovery passageway 33 near but spaced upwardly from the terminal end of spout 30 such that vapors enter the vapor recovery passageway 33 spaced from the terminal end of spout 30. In the embodiment of the present invention illustrated in FIGS. 1–3 and 6, there are a series of inlet openings 36 spaced along the spout 30 from a point adjacent the terminal end thereof to a point spaced a predetermined distance upwardly and inwardly therealong. The series of spaced inlet openings 36 preferably extend along spout 30 such that the innermost inlet opening 36 will be closely adjacent to but still on the fuel tank side of the restrictor plate R located in the fill tubes of all vehicle fuel tanks. Thus, vapors are recovered from the fuel tank up to and including the space immediately below the restrictor plate R. The total cross-sectional area of inlet openings 36 is such that a substantially unrestricted vapor recovery inlet is provided to passageway 33.

Vapors entering the vapor recovery passageway 33 through inlet openings 36 are exhausted from vapor recovery passageway 33 through an outlet opening 37 formed in the outer wall of spout 30 at a point immediately adjacent plug 34. Preferably, exhaust opening 37 is sufficiently large to provide an unrestricted outlet for the vapors passing through the passageway 33.

The vapors recovered from the vehicle fuel tank and passing through vapor recovery passageway 33 exit through outlet opening 37 externally of the extension 24*a* of body portion 21 and are confined and directed into the end 26*a* of the vapor recovery passageway 26 in body portion 21 by a vapor confinement and directing means 40. Vapor confinement and directing means 40 preferably is in the form of a hollow sleeve which has a frusto-conical section 40*a* and a generally cylindrical section 40*h*. The frusto-conical section 40*a* has its smallest end surrounding the inner end portion of spout body portion 30*a* at a point outwardly of the exhaust opening 37 and in sealing engagement therewith. The cylindrical portion 40*b* of vapor confinement and directing means 40 surrounds the terminal end of the egress end portion 24 of body portion 21. Preferably, the terminal end of egress end portion 24 has an outwardly facing groove 41 formed therein and the cylindrical portion 40*b* of vapor confinement and directing means 40 has an inwardly facing rib 42 which is received in and complements the outwardly facing groove 41 of the terminal end of egress portion 24. Also, a locking ring 42 is received around the cylindrical portion 40*b* opposite the rib 42 to lock cylindrical portion 40*b* into sealing engagement with the terminal end of egress end portion 24. While any locking ring may be employed, a particular example of such a locking ring is an Oeticker clamp.

Figure 7:
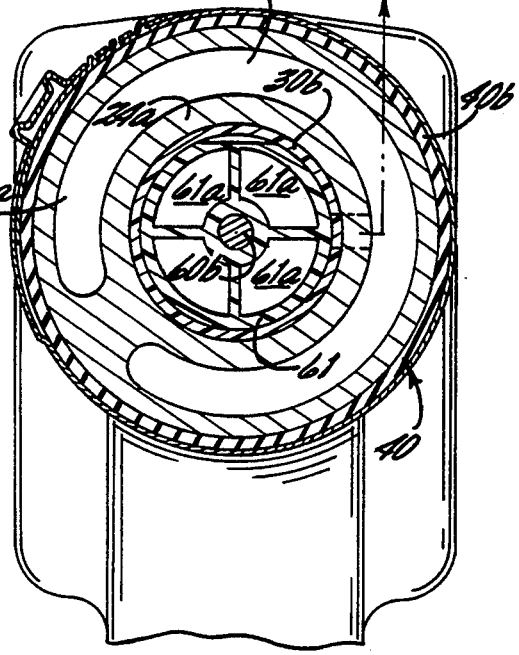
FIG. 7 is an enlarged fragmentary sectional view taken substantially along line 7—7 in FIG. 6.

As shown in FIG. 7, the end 26*a* of vapor recovery passageway 26 is of enlarged cross-sectional area and therefore can receive and confine vapors within that total area without any restriction or other impediment thereto. The main portion of passageway 26 then receives and conveys the vapors through to the end 26*b* thereof where the vapor recovery conduit 23*a* in hose 23 receives and conveys the vapors back to the vacuum pump. The vapor confinement and directing means 40 is formed of a flexible resilient material which is able to withstand substantial physical abuse and the vapors of fossil fuels without deterioration. Also, the same is able to withstand sunlight and other conditions which fuel dispensing nozzles normally encountered in use. One example of an acceptable material of which the fuel confinement and delivery means 40 can be constructed is a synthetic rubber, such as Viton, manufactured and sold by E. I. DuPont de Nemours or a similar material sold by Minnesota Rubber Company.

The body portion 21 and particularly the fuel passageway 25 has a main valve 50 mounted therein which includes a valve member 51 moveable between a closed position in which the valve member 51 is seated against a valve seat 52 surrounding a portion of the fuel passageway 25 and an open position spaced from the valve seat 52. Valve member 51 is biased toward the closed position by a coil spring 53 such that the valve member 51 normally occupies a position seated against the valve seat 52 and closing the fuel passageway 25 through body portion 21.

Valve member 51 is mounted on a valve stem 54 which is slideably mounted for longitudinal movement by a valve stem mounting member 55. The outer end of valve stem 54 engages and rests against a valve actuating lever 56 which has a hand engaging portion 57 adapted to be grasped by the fingers of the hand of an operator using nozzle 20. The end portion 58 of lever 56 opposite the hand engaging portion 57 is pivotally mounted by a pivot pin 59. Accordingly, under normal conditions when hand engaging portion 57 is grasped and moved upwardly by an operator, the valve actuating lever 56 pivots about pivot pin 59 and moves valve stem 54 upwardly to move valve member 51 away from valve seat 52 and open main valve 50 to permit fuel to flow through the fuel passageway 25.

A secondary, check valve 60 is mounted in fuel passageway 25 downstream of main valve 50. Check valve 60 includes a valve member 60*a* carried by a valve stem 60*b* and is biased toward a valve seat 60*c* by a spring 60*d*. Valve stem 60*h* is mounted in a check valve mounting member 61 positioned in fuel passageway 25 and having holes 61*a* therethrough (FIG. 7) forming a part of fuel passageway 25.

Check valve 60 faces upstream in fuel passageway 25 and opens when main valve 50 is open and fuel of a predetermined pressure reaches check valve member 60*a*. Once main valve 50 closes and pressure on check valve 60 decreases, check valve 60 will close to prevent any fuel in passageway 25 downstream of main valve 50 from leaking out of nozzle 20.

Nozzle 20 is equipped with a automatic shut-off mechanism which will cause main valve means 50 to close once the vehicle tank is full of fuel. Such automatic shut-off means includes an elongate pivot mounting member 62 which carries pivot pin 59 at one end thereof. Pivot mounting member 62 is slideably mounted in a sleeve 63 which in turn is mounted in body portion 21. Preferably, pivot mounting member 62 is rectangular in cross-section such that it cannot rotate relative to the sleeve 63 which itself is fixed against movement in the body portion 21. Pivot mounting member 62 is biased in an upward direction by a coil spring 64 which surrounds the upper end portion of the pivot mounting member 62.

Figure 4:
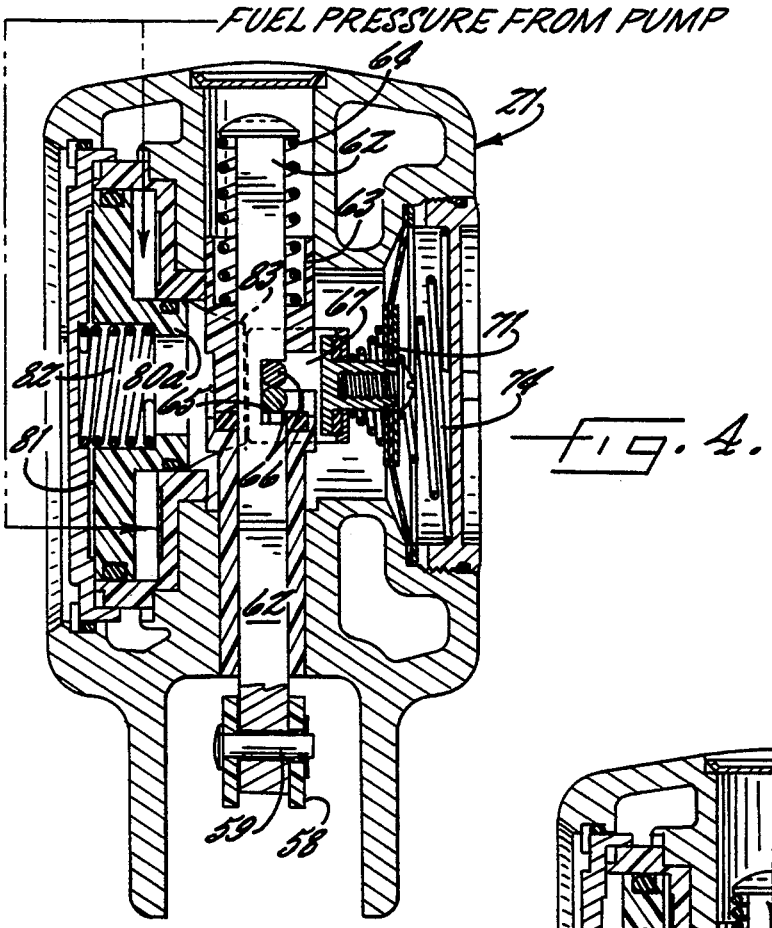
FIG. 4 is an enlarged transverse sectional view taken substantially along 4—4 in FIG. 2.
Figure 5:
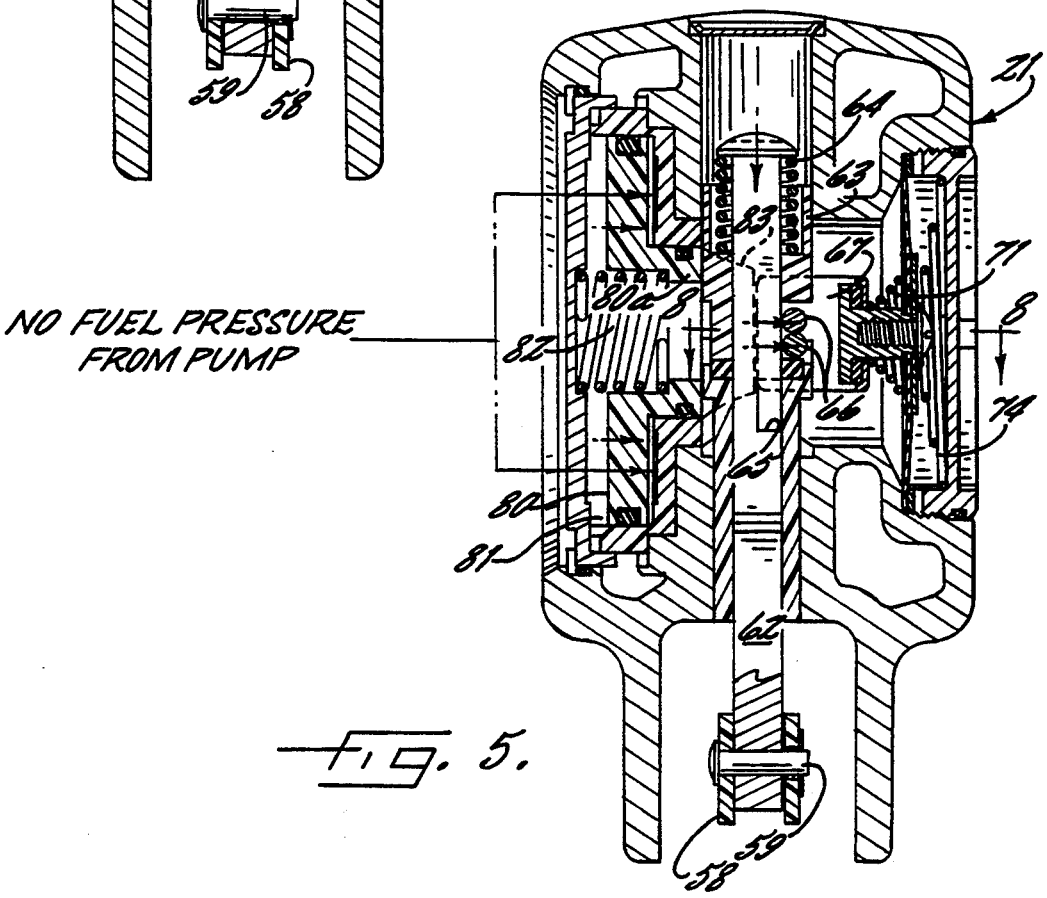
FIG. 5 is a view similar to FIG. 4, illustrating the automatic shut-off mechanism in position shutting off the flow of fuel through the nozzle.
Figure 6:
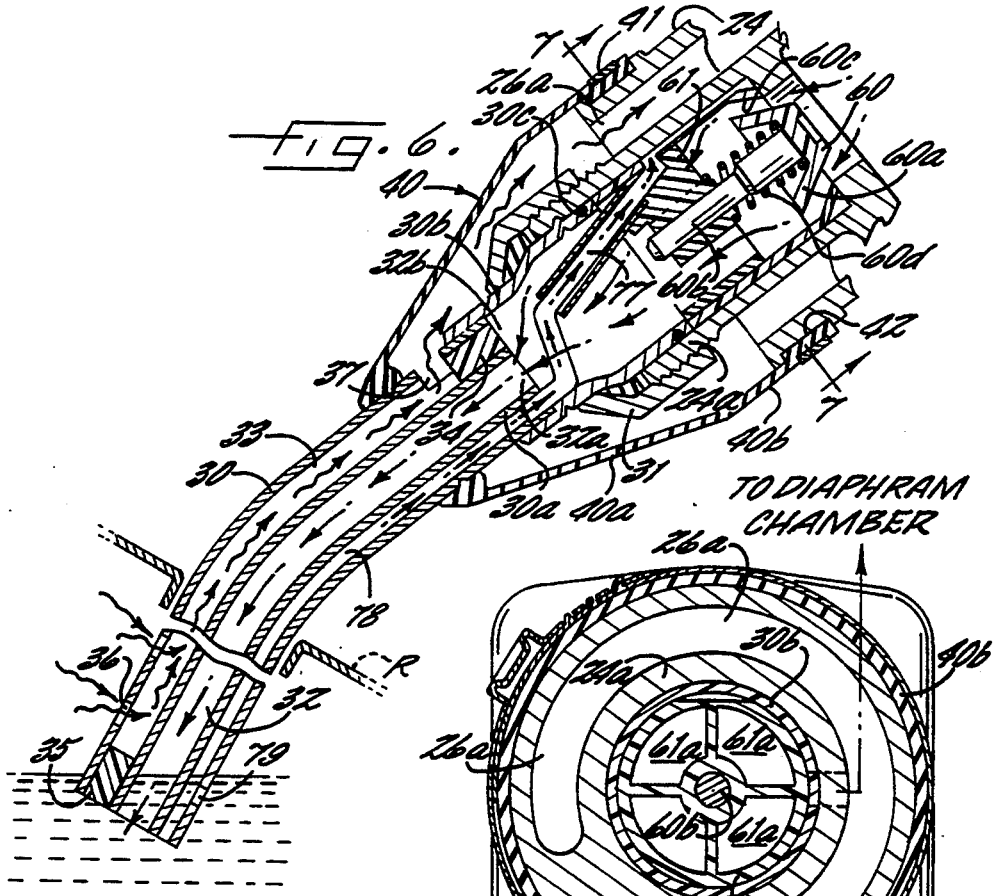
FIG. 6 is a fragmentary sectional view of the spout and vapor recovery confinement means illustrated in the left hand portion of FIG. 2.
Figure 8:
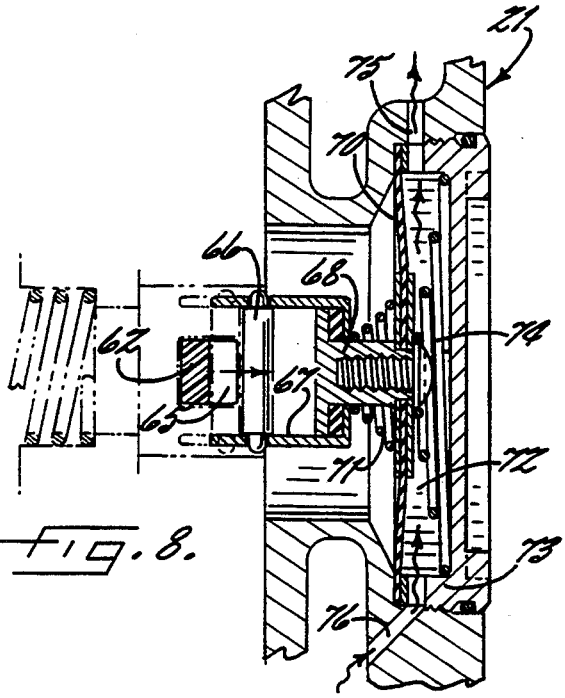
FIG. 8 is an enlarged fragmentary sectional view of the fuel pressure responsive mechanism shown in the left portions of FIGS. 4 and 5.

A groove 65 is located in one side of the pivot mounting member 62 as is best shown in FIGS. 4 and 5. A pair of locking pins 66 are receivable in the groove 65 to hold the pivot mounting member 62 against reciprocatory sliding movement within the sleeve 63. The pins 66 are mounted at their opposite ends in a U-shaped member 67 (FIG. 8). U-shaped member 67 is loosely mounted on a connector member 68 which is connected at its other end to a diaphragm 70. A coil spring 71 is positioned between the U-shaped member 67 and the diaphragm 70 to bias the U-shaped member 67 toward the pivot mounting member 62.

Diaphragm 70 is formed of a flexible resilient material and forms one side of a vacuum chamber 72, the other side and outer periphery of which is defined by a chamber member 73 mounted on body portion 21. A coil spring 74 is positioned within chamber 72 and biases the diaphragm 70 toward the pivot mounting member 62 and thereby biases the pins 66 toward the pivot mounting member 62 and toward their operative position within groove 65.

Vacuum chamber 72 is connected at one side thereof to a venturi 75 which communicates at its opposite end with the fuel passageway 25 through body portion 21. The other side of vacuum chamber 72 is communicatively connected to a passageway 76 which in turn is connected by a conduit 77 to the inner end of a shut-off passageway 78 in spout body portion 30*a*. Spout shut-off passageway 78 extends longitudinally through spout 30 from the outer terminal end thereof to the inner end of body portion 30*a*. Therefore, under normal fuel dispensing operation, the outer end of the shut-off passageway 78 is open and air freely passes thereinto and through the conduit 77 and passageway 76 into the vacuum chamber 72. Preferably, a small inlet hole 79 is formed in the side wall of spout 30 adjacent to but spaced a predetermined distance from the outer terminal end of spout 30 to prevent the formation of a vacuum until not only the terminal end of spout 30 is closed by fuel but the entire outer end portion thereof is covered by fuel. Preferably, hole 79 is spaced inwardly from the terminal end of spout 30 approximately one inch.

Figure 9:
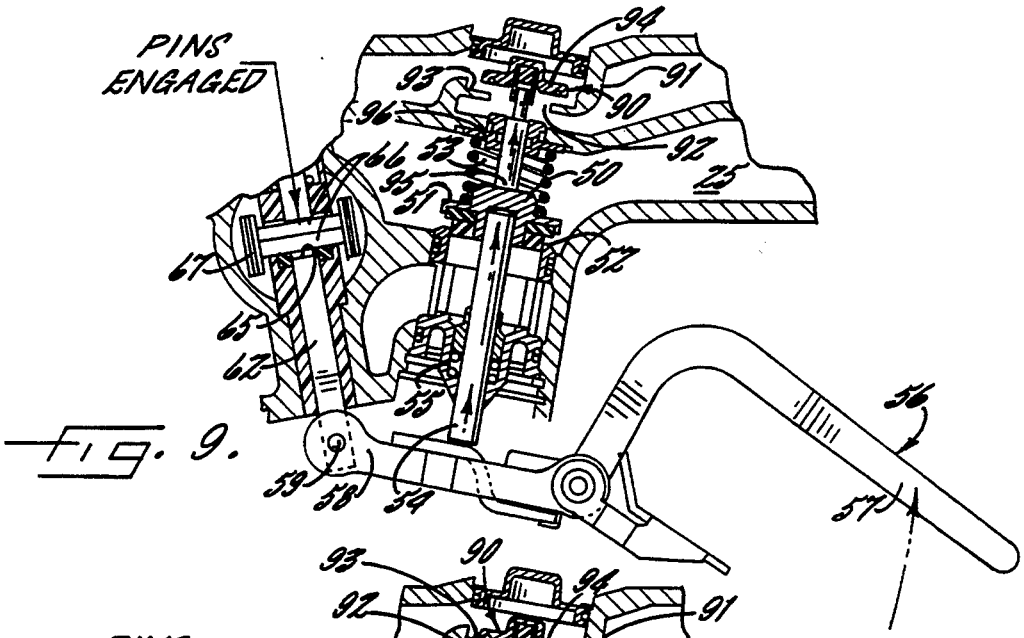
FIG. 9 is an enlarged fragmentary sectional view illustrating the manually operable valve actuating lever, main valve and a portion of the automatic shut-off means shown in the medial part of FIGS. 1 and 2.

When main valve 50 is open and fuel flows through fuel passageway 25 in body portion 21 and through spout 30 into the vehicle fuel tank, the flow of fuel past the venturi 75 creates a partial vacuum in the venturi 75 and thence in the vacuum chamber 72. So long as spout shut-off passageway 78 remains unobstructed, air will flow through spout passageway 78, connector tube 77, and passageway 76 into the vacuum chamber 72 and the diaphragm 70 will be maintained in its normal, inoperative position, as illustrated in FIG. 4. In this position, the pins 66 will be positioned in the groove 65 and the pivot mounting member 62 will be locked against reciprocatory sliding movement and the pivot pin 59 will thus be held stationary (FIG. 9).

Figure 10:
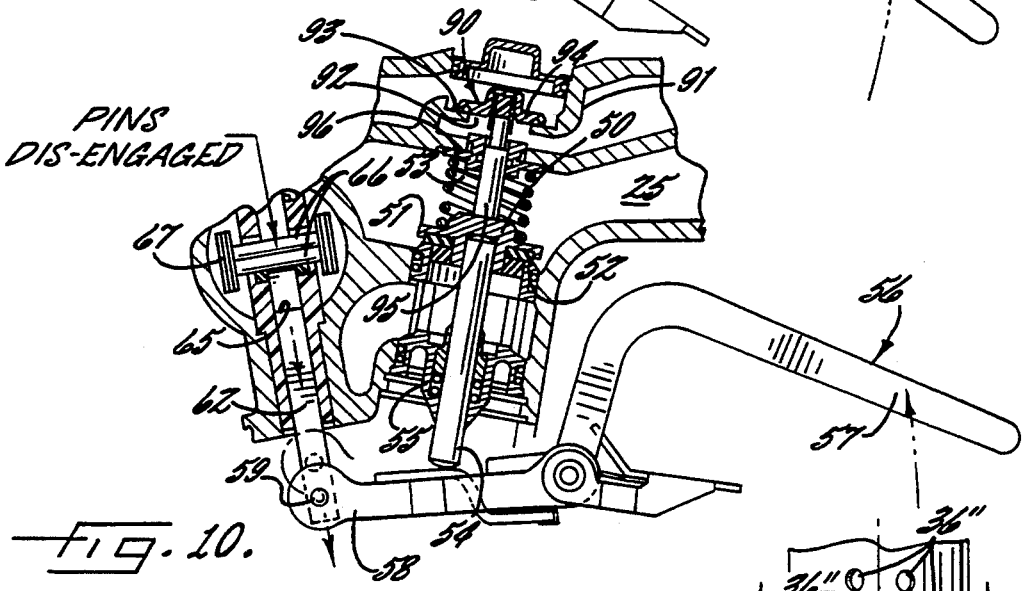
FIG. 10 is a view similar to FIG. 9 illustrating the automatic shut-off means disengaged.

Once the spout shut-off passageway 78 becomes blocked, i.e. both the open terminal end and the hole 79 thereinto, air can no longer enter spout passageway 78 and thence into the vacuum chamber 72. Accordingly, the venturi 75 will draw a vacuum on chamber 72 sufficient to overcome the pressure of spring 74 and cause diaphragm 70 to move to the right as seen in FIGS. 4, 5 and 8. Once diaphragm 70 moves to the operative position, connector member 68 and U-shaped member 67 will withdraw pins 66 from groove 65 in pivot mounting member 62. With pins 66 withdrawn from groove 65, pivot mounting member 62 is free to move downwardly and pivot pin 59 is no longer fixed or held stationary (FIG. 10).

When this occurs, the pivot point for the valve actuating member 56 becomes the end of valve stem 54 and coil spring 53 will be permitted to move valve member 51 against valve seat 52 thereby terminating the flow of fuel through fuel passageway 25 of body portion 21 and fuel passageway 32 of spout 30. Once fuel flow through the fuel passageway 25 ceases, venturi 75 will no longer create a vacuum in vacuum chamber 72 and spring 74 can move diaphragm 70 toward its inoperative position. Such movement of diaphragm 70 causes pins 66 to be moved toward pivot mounting member 62. Because the groove 65 will not be in mating alignment with the pins 66, the U-shaped member 67 cannot move the pins back into the groove 65, but the spring 71 will permit relative movement between the U-shaped member 67 and the connector member 68 such that the pins 66 are spring biased against the side of the pivot mounting member 62. Once the operator releases the hand engaging portion 57 of the valve actuating lever 56, the spring 64 will move pivot mounting member 62 upwardly to bring the groove 65 into alignment with the pins 66 and spring 71 will then move the U-shaped member 67 and pins 66 to the left as seen in FIGS. 4, 5 and 8 to again position pins 66 in grove 65 in pivot mounting member 62. The nozzle 20 will be again ready to dispense fuel into a vehicle tank until the spout shut-off passageway 78 is again blocked.

Nozzle 20 includes a further safety feature which ensures that the nozzle 20 cannot dispense any residual fuel left in fuel passageway 25 or fuel delivery hose 23 when the dispensing pump that supplies fuel through the hose 23 to the nozzle is inoperative. To this end, a fuel pressure sensing member 80 is slideably mounted in a fuel pressure chamber 81 (FIGS. 4 and 5). Pressure chamber 81 is communicatively connected to the fuel passageway 25 in body portion 21. Fuel pressure sensing member 80 is movably mounted in chamber 81 and is biased toward the right as seen in FIGS. 4 and 5 by a coil spring 82. Fuel pressure sensing member 80 has an extension 80*a* extending toward the pivot mounting member 62 and the U-shaped member 67 carrying pins 66. The end of the extension 80*a* engages a spider member 83 which straddles the sleeve 63 and is adapted to engage the U-shaped member 67 and to move the U-shaped member 67 to the right as seen in FIGS. 4, 5 and 8 when fuel pressure sensing member 80 is moved to the right by spring 82.

When the fuel dispensing pump is turned on, the pump will create a fuel pressure through the hose 23 and in the fuel passageway 25 up to the valve member 50 and including the fuel pressure chamber 81. Such pressure will cause the pressure sensing member 80 to move to the left as seen in FIG. 4 against the action of spring 82 which will move the spider member 83 out of contact with the U-shaped member 67 and permit the pins 66 to seat properly within the groove 65 and pivot mounting member 62. The nozzle 20 is thus properly primed for operation to dispense fuel into a vehicle fuel tank.

However, until the dispensing pump is turned on, there is no fuel pressure in fuel passageway 25 nor in chamber 81. Accordingly, spring 82 can move fuel pressure sensing member 80 to the right which will cause the spider member 83 to move the U-shaped member 67 to the right against the action of spring 70 which will move the pins 66 out of groove 65 in pivot mounting member 62. Accordingly, the main valve 50 cannot be opened even if the valve actuating lever 56 is moved upwardly because the pivot pin 59 will move downwardly and no pressure can be applied to the valve stem 54.

In many fuel dispensing systems having vapor recovery capability, the vapor recovery vacuum pump is actuated when the fuel dispensing pump is rendered operative. If the vapor recovery passageway 26 in body portion 21 and passageway 33 in spout 30 are open, undesirable air will be sucked through nozzle 20 and vapor recovery conduit 23*a* into the underground tank. Accordingly, nozzle 20 includes a vapor recovery shut-off means 90 (FIG. 1) for closing the vapor recovery passageway 26 at all times when fuel is not being dispensed into a vehicle fuel tank.

Shut-off means 90 comprises a partition 91 extending laterally across vapor recovery passageway 26 to preclude the passage of vapors through passageway 26 except through an opening 92 in partition 91. A valve seat 93 surrounds opening 92 on the upper side of partition 91 and a valve member 94 normally rests on valve seat 93 and normally closes opening 92. Valve member 94 is carried by the upper end of a valve stem 95, the lower end of which is carried by main valve member 50. Valve stem 95 is mounted for reciprocatory movement by a bearing member 96.

Shut-off means 90 normally closes vapor recovery passageway 26 when main valve 50 is closed and no fuel is being dispensed through nozzle 20. When main valve 50 is opened to dispense fuel through nozzle 20, valve member 94 will be moved upwardly by main valve member 50 moving valve stem 95 upwardly to open the opening 92 through partition 91 and permit the flow of vapors therethrough.

Figure 11:
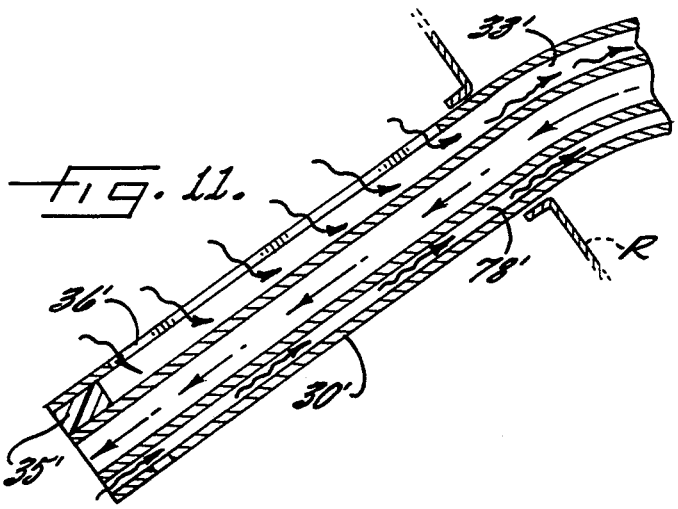
FIG. 11 is a fragmentary sectional view of the outer end portion of the spout of another embodiment of the nozzle of this invention.

Referring now to FIG. 11 in which another embodiment of the spout of the present invention is illustrated and in which like reference characters are used with the prime notation, there is shown a spout 30' having a vapor recovery passageway 33' therein. Vapor recovery passageway 33' has an inlet opening 36' in the outer end portion of the spout 30'. Inlet opening 36' is in the form of an elongate slot which extends from a point closely adjacent the outer terminal end of spout 30' to a location which will position the inner end of slot 36' adjacent the restrictor plate R in the fill tube of a vehicle fuel tank.

Figure 12:
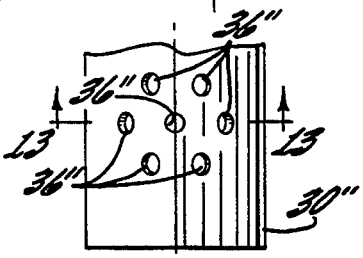
FIG. 12 is a fragmentary elevational view of the outer end of the spout of a further embodiment of the nozzle of this invention.
Figure 13:
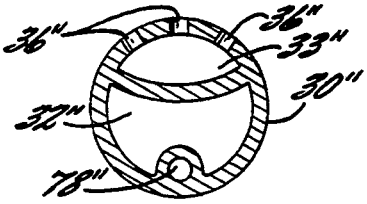
FIG. 13 is a transverse sectional view taken substantially along line 13—13 in FIG. 12.

In FIGS. 12 and 13, there is illustrated still another embodiment of the spout of the present invention in which like reference characters are used with the double prime notation added. In this arrangement, spout 30'' includes a plurality of inlet openings 36'' which are grouped in an oval pattern. This oval pattern of inlet openings 86'' has particular application where a wide variety of restrictor plate locations within the fill tubes of vehicle fuel tanks is expected to be encountered in the use of nozzle 20.

In the drawings and specification there has been set forth a preferred embodiment of the invention, and although specific terms are employed, they are used in a generic and descriptive sense only and not for purposes of limitation.

That which is claimed is:

1. A fuel dispensing nozzle characterized by improved vapor recovery comprising:

(a) a body portion having an ingress end and an egress end and having a fuel passageway extending from an ingress end of said body portion to an egress end of said body portion thereof, the ingress end of said body portion being adapted to be connected to a hose for delivering fuel from a pump to said nozzle, said body portion also having a vapor recovery passageway extending from the egress end to the ingress end thereof, (b) a spout having an inner end carried by the egress end of said body portion and extending outwardly therefrom and terminating in an outer end, said spout including a fuel dispensing passageway extending therethrough from said inner end to said outer end and being communicatively connected at its inner end to said fuel passageway in said body portion for dispensing fuel into a vehicle fuel tank, said spout also including a vapor recovery passageway extending longitudinally therein and having at least one inlet opening adjacent the outer end of said spout and an outlet opening in said spout adjacent but spaced outwardly from the inner end of said spout and outwardly from the egress end of said body portion, and (c) vapor confinement means surrounding the portion of said spout having the vapor outlet opening therein and the egress end of said body portion and sealingly engaging said spout outwardly of said vapor outlet opening and surrounding said egress end of said body portion and defining a vapor confining chamber of substantially greater volume than the vapor recovery passageways in said spout and in said body portion and communicating with said outlet opening of said vapor recovery passageway in said spout and with said vapor recovery passageway in said body portion, whereby vapor may be recovered from a vehicle tank by entering the vapor recovery passageway in said spout through the inlet opening passing through the spout and out through the outlet opening into the vapor confinement chamber and thence into said vapor recovery passageway in said body portion.

2. A fuel dispensing nozzle according to claim 1 wherein said spout vapor recovery passageway has a plurality of spaced apart inlet openings from a point adjacent the outer end of said spout for a predetermined distance along said spout to a point which will be closely adjacent the restrictor plate in the fill tube of a vehicle tank when the spout is inserted therein.

3. A fuel dispensing nozzle according to claim 1 wherein said inlet opening into said spout vapor recovery passageway comprises an elongate slot extending from a point adjacent the outer end of said spout for a predetermined distance to a point which will be closely adjacent the restrictor plate in the fill tube of a vehicle tank when the spout is inserted therein.

4. A fuel dispensing nozzle according to claim 1 wherein said spout vapor recovery passageway has a plurality of spaced apart inlet openings arranged in a generally oval group and providing a large inlet area for substantially unrestricted vapor recovery.

5. A fuel dispensing nozzle according to claim 1 wherein said vapor confinement means comprises a hollow, flexible member having an outer end portion surrounding and sealingly engaging said spout at a location between the inlet and outlet openings in said vapor recovery passageway through said spout and an inner end portion surrounding and sealingly engaging the egress end of said main body portion.

6. A fuel dispensing nozzle according to claim 5 wherein said flexible vapor confinement member is formed of a flexible, resilient synthetic rubber.

7. A fuel dispensing nozzle according to claim 1 wherein said spout is formed of a unitary extrusion having the fuel dispensing and vapor recovery passageways formed therein by extrusion.

8. A fuel dispensing nozzle according to claim 7 wherein the vapor recovery passageway extends longitudinally through said spout and including plug means blocking the vapor recovery passageway at its outer end outwardly of the inlet opening and at its inner end inwardly of the outlet opening.

* * * * *